United States Patent [19]

Smith, Jr. et al.

[11] Patent Number: 4,871,511

[45] Date of Patent: Oct. 3, 1989

[54] MARAGING STEEL

[75] Inventors: Darrell F. Smith, Jr., Huntington; Louis G. Coffee, Ceredo, both of W. Va.

[73] Assignee: Inco Alloys International, Inc., Huntington, W. Va.

[21] Appl. No.: 151,120

[22] Filed: Feb. 1, 1988

[51] Int. Cl.[4] ..... C22C 38/08

[52] U.S. Cl. ..... 420/96; 148/328; 148/336

[58] Field of Search ..... 148/328, 336, 142; 420/96

[56] References Cited

U.S. PATENT DOCUMENTS

| | | | |
|---|---|---|---|
| 3,093,518 | 6/1963 | Bieber | 420/94 |
| 3,093,519 | 6/1963 | Decker et al. | 420/96 |
| 3,243,285 | 3/1966 | Fragetta et al. | 420/95 |
| 3,309,243 | 3/1967 | Corrigan | 420/95 |
| 3,318,690 | 5/1967 | Floreen et al. | 420/94 |
| 3,392,065 | 7/1968 | Bieber et al. | 420/96 |
| 4,443,254 | 4/1984 | Floreen | 420/96 |
| 4,572,738 | 2/1986 | Korenko et al. | 420/96 |
| 4,579,590 | 4/1986 | Asayama et al. | 148/142 |

FOREIGN PATENT DOCUMENTS

| | | |
|---|---|---|
| 1035756 | 7/1966 | United Kingdom . |
| 1046054 | 10/1966 | United Kingdom . |
| 1355475 | 6/1974 | United Kingdom . |

OTHER PUBLICATIONS

Maraging Nickel Steels, The International Nickel, pp. 1–9 (1962).

Article from the Transactions of the ASM, 1964, vol. 57, S. Floreen; "Hardening Behavior of Ternary Alloys", pp. 38–47.

National Aeronautics & Space Administration–Survey NASA SP-5051 entitled The Metallurgy, Behavior, and Application of the 18-Percent Nickel Maraging Steels, pp. 1–3, 5–125, 127–137.

*Primary Examiner*—Deborah Yee

*Attorney, Agent, or Firm*—Francis J. Mulligan, Jr.; Edward A. Steen

[57] ABSTRACT

The present invention is directed to maraging steels, and particularly to a maraging steel of the cobalt-free type possessing such a combination of strength and fracture toughness that it is suitable for use in respect of demanding applications requiring product forms of very substantial section size.

9 Claims, No Drawings

MARAGING STEEL

INVENTION BACKGROUND

Maraging steels were first discovered circa 25–30 years ago and have witnessed substantial use i sundry and diverse appications. As set forth in U.S. Pat. 4,443,254 ('254), the steels that were of initial commercial significance contained roughly 7–9% cobalt, the cobalt-free versions lacking sufficient toughness for commercial acceptance. The cobalt-free alloy of '254 obviated this drawback and in but a few years has been well received in the marketplace worldwide.

The virtues of '254 notwithstanding, there are applications in which the maraging steel described therein is deemed wanting. Illustrative of this would be appications such as large rocket motor casings where product forms of very substantial thickness are required. As is known, rocket motor casings run 12 –14 feet or more in diameter with a wall thickness of about one-half inch (flange section may run 2–2½ inchesin thickness). This requires a melt charge of roughly 60,000–65,000 pounds of metal to obtain a forging billet upwards of 40–44 inches thick. Forged rings used in conjunction with such casings also run 12–14 feet in diameter.

Material to be used for rocket motor casings and forged rings should be characterized by a high level of $K_{IC}$ fracture toughness as well as strength. the alloy currently used is a high strength, low alloy steel known as D6AC, a steel containing about 0.45% carbon, 1% chromium, 1% molybdenum, 0.5% nickel in addition to iron and impurities. Depending upon tempering treatment it is understood to have a $K_{IC}$ value on the order of 75 Zksi $\sqrt{in}$ at a yield strength in the neighborhood of 200,000 psi. The steel is usually or often liquid quenched and this can give rise to dimensional changes. What is desired for such application is a $K_{IC}$ above 75 ksi $\sqrt{in}$ and upwards of a 90–100 Ksi square root inch fracture toughness. But to acheive this level at the sacrifice of strength is not a panacea. Thus, an alloy must also be of high yield strength, i.e., well above 200,000 psi and advantageously at least 220,000 psi.

The commercial steel f '254, known as MS-250, contains about 1.35 to 1.45% titanium together with about 3% molybdenum, 18% nickel and low carbon. It is aged at 900° F. and affords strengths of 240,000–250,000 psi. While strong enough, its $K_{IC}$ value is somewhat lacking, being around 70 ksi $\sqrt{in}$ with Charpy V-Notch value of about 15–20 foot-pounds or slightly higher.

INVENTION SUMMARY

It has now been discovered that if the maraging steel composition of '254 is modified in respect of the titanium content and is aged in accordance herewith, a cobalt-free steel can be produced in large section sizes, over 40 inches in diameter, the steel affording yield strengths (0.2% offset) of 220,000 psi and above together with $K_{IC}$ values of well over 75 ksi $\sqrt{in}$, e.g., 100 ksi $\sqrt{in}$, and a CVN impact strength of over 30foot-pounds, e.g., 32 to 40 foot-pounds.

INVENTION EMBODIMENTS

Generally speaking, the present invention contemplates a maraging steel containing at least 1% and up to about 1.25% titanium, about 2 to about 4% molybdenum about 17 to about 19% nickel, carbon up to 0.05%, aluminum in a small amount, e.g., 0.05%, up to 1%, and the balance essentially iron. The terms "balance" or "balance essentially" iron do not exclude the presence of other elements commonly present as incidentals, e.g., deoxidizing and cleansing elements, and impurities ordinarily present in such steels in amounts which do not adversely affect the steel above described. Vanadium, tantalum, niobiuum and tungsten can be present up to or 2% each. The subject steel may also contain up to 0.25% each of boron and zirconium, up to 1% each of silicon and manganese, small amounts up to 0.25% of calcium and/or magnesium. Sulfur, hydrogen, oxygen and phosphorus should be held to low levels consistent with good steelmaking practice. Cobalt is not required but small amounts can be present.

Apart from compositional considerations the instant maraging steel should be aged above 900° F. and up to less than 1100° F. for 1 to 10 hours. As will be more fully described infra, it is beneficial to correlate titanium content and aging temperature.

In carrying the invention into practice it is preferred that the titanium level be above 1.1% to assist in achieving satisfactory strength levels and fracture toughness. It need not exceed 1.25% but can be as high as 1.4% where optimum fracture toughness is not required. While the nickel content may be as low as 16.5% it is preferred that it be within the range of 17.5 to 18.5%. Percentages as high as 20 or 21% may be used but little is to be gained and a loss of strength could result. Problems of retained austenite might ensue. A molybdenum rangeof 2.5 to 3.5% is advantageous in respect of both strength and toughness. In striving for optimum toughness the carbon should not exceed 0.03%. Aluminum need not exceed 0.5%. It is present principally for deoxidation purposes but it confers other benefits. A range of 0.05 to 0.35% is satisfactory.

In terms of aging temperature and titanium content these are preferably correlated as follows to give the best combinations of strength and fracture toughness:

| Titanium Content, % | Aging Temperature, °F. |
|---|---|
| 1.3–1.4 | at least 975, preferably not more than 1075 |
| 1.2–1.3 | at least 950, preferably at least 1000 |
| 1.1–1.2 | at least 925, preferably not more than 1000 |

At the upper end of the titanium range, the highest aging temperatures lend to excellent fracture toughness while enabling satisfactory yield strengths to be achieved. A lower temperature can be used at the lower end of the titanium range and this lends to both toughness and strength.

With regard to general processing of the alloy, melting can be carried out in an AOD (argon-oxygen decarburization) furnace followed by vacuum induction melting (VIM) followed by vacuum arc remelting (VAR). It is considered that VIM plus VAR may be sufficient. Hot working of ingots should be conducted over the temperature range of 1600° to 2050° F., preferably 1700° to 1950° F. At temperature above 2050° F. excessive oxidation may occur. Experience indicates that mechanical properties are relatively insensitive to cooling rate from hot working. air cooling can be employed but the entire ingot cross-section should be cooled sufficiently such that the temperature drops below the martensitic transformation temperature (circa 250° F.). Liquid quenching may lead to thermal cracking, given the large section sizes contemplated. If desired, cold working can be applied, the work hardening rate being rather low. Conventional machining and grinding operations should be employed prior to heat treatment.

Concerning annealing treatments, temperatures of from about 1350 to 1700° F. for about one or more hours, depending upon section size, are deemed satisfactory. As such, the subject steel is fully austenitized (about 1350° F.). For best results and considering structure, properties and grain size an anneal within 1400 to 1600° F. is recommended. Re-annealing treatments can result in grain refinement. Sinceair-cooling, i.e., non-liquid quenching, can be utilized, little if any dimensional change occurs on transformation to martensite. Put another way, good dimensional tolerance is a characteristic attribute of the invention maraging steel.

The following data are offered to give those skilled in the art a general perspective anent the characteristics of the alloy forming the present invention.

Both a high titanium (1.41%) and lower titanium (1.26%) alloy were prepared in the form of 5 inch and 3 inch hot rolled rounds. The compositions are given in Table I and test results are reported in Table II.

TABLE I

| CHEMICAL ANALYSIS | Alloy 1 | Alloy 2 |
|---|---|---|
| Nickel | 18.20 | 18.11 |
| Molybdenum | 3.06 | 3.07 |
| Titanium | 1.26 | 1.41 |
| Aluminum | 0.09 | 0.09 |
| Carbon | <0.01 | 0.01 |
| Silicon | 0.01 | 0.01 |
| Manganese | 0.02 | 0.03 |
| Boron | 0.003 | 0.003 |
| Zirconium | Low | Low |
| Iron* | 77.36 | 77.83 |

*Impurity levels of Cu, P, S, Cr, Co, etc.

TABLE II

EFFECT OF AGING TREATMENT ON RTT, CVN AND FRACTURE TOUGHNESS
Product: Hot Rolled Round, Diameter Shown
Test Orientation: Longitudinal

| Alloy | Dia. | Age °F./h | HD RC | YS ksi | TS ksi | El, % | RA, % | CVN ft-lb | $K_{IC}$ ksi $\sqrt{in}$ |
|---|---|---|---|---|---|---|---|---|---|
| 1 | 3" | 900/4 | 46 | 245.7 | 256.1 | 13 | 53 | 27, 24 | 82.7, 85 |
| | 3" | 950/4 | 46 | 232.3 | 243.2 | 12 | 57 | 35 | |
| | 3" | 1000/1 | 45 | 229.2 | 240.8 | 12 | 60 | 33 | |
| | 3" | 1000/4 | 45 | 221.3 | 229.5 | 13 | 47 | 37, 40 | 110, 112.7 |
| | 3" | 1100/4 | 38 | 111.9 | 185.5 | 19 | 65 | 80 | |
| 2 | 5" | 950/4 | 50 | 244.5 | 254.6 | 10 | 53 | 21 | |
| | 5" | 1000/1 | 49 | 238.8 | 249.6 | 11 | 54 | 27 | |
| | 5" | 1000/4 | 48 | 231.3 | 240.3 | 11 | 53 | 23 | 93.2, 91.9 |
| | 5" | 1100/4 | 42 | 123.5 | 191.3 | 19 | 59 | 65 | |

As can be observed from a cursory review of Tables I and II, yield strengths of about 220,000 psi can be obtained with fracture $K_{IC}$ toughness levels well above 90 ksi $\sqrt{in}$ together with Charpy V-Notch impact energies of well over 25 foot-pounds and up to near 40 foot-pounds. It is noteworthy that the 1.265 titanium alloy at a 1000° F. age resulted in an average yield strength of over 220,000 psi, an average CVN of 35 foot-pounds and a $K_{IC}$ value of near 110 square root inch fracture toughness.

While there is illustrated and described herein specific embodiments of the invention, those skilled in the art will understand that changes may be made in the form of the invention covered by the claims and that certain features of the invention may sometimes be used to advantage without a corresponding use of the other features.

The embodiments of the inventionin which an exclusive property or privilege is claimed are defined as follows:

1. A maraging steel characterized by a combination of (a) high yield strength, (b) $K_{IC}$ fracture toughness and (c) the ability to absorb impact energy as determined by the Charpy V-Notch impact test, said steel consisting essentially of 16.5 to 20% nickel, over 1 to about 1.4% titanium, about 2 to about 4% molybdenum, up to 0.05% carbon, up to 1% aluminum, the balance being iron, said alloy having been aged at a temperature of from above 950 to less than 1100° F. and the yield strength is at least 200,000 psi, the $K_{IC}$ fracture toughness is over 75 ksi $\sqrt{in}$ and the impact energy is over 25 foot pounds.

2. A maraging steel as set forth in claim 1 in which the steel has been aged at from about 975 to about 1025° F. for about 1 to 10 hours.

3. A maraging steel as set forth in claim 1 in which the aging temperature is about 1000° to not more than 1075° F. and the treatment does not exceed about 5 hours.

4. A maraging steel characterized by a combination of (a) high yield strength, (b) $K_{IC}$ fracture toughness and (c) the ability to absorb impact energy as determined by the Charpy V-Notch impact test, said alloy consisting of about 17 to about 19% nickel, about 1 to less than 1.25% titanium, about 2 to 4% molybdenum, up to 0.03% carbon, aluminum present up to 0.5% with the balance being iron, said alloy being further characterized that in the aged condition the yield strength is at least 200,000 psi, the $K_{IC}$ fracture toughness is over 90 ksi $\sqrt{in}$ and the impact energy is over 30 foot-pounds.

5. A maraging steel characterized by a combination of high yield strength and $K_{IC}$ fracture toughness together with an excellent ability to absorb impact energy as determined by the Charpy V-Notch impact test, said steel consisting essentially of about 17 to 19% nickel, about 1 to 1.25% titanium, about 2 to 4% molybdenum, up to 0.03% carbon, aluminum from 0.05 to 0.5%, with the balance being iron, said alloy having been aged at a temperature from about 925° F. to less than 1100° F. for 1 to 5 hours.

6. The marging steel set forth in claim 5 in which the steel has been aged at a temperature from at least 950° F.

7. The maraging steel set forth in claim 5 in which the steel has been aged at a temperature of about 1000° F. to 1025° F.

8. A forging billet formed from the steel of claim 4 and having section size of at least 40 inches.

9. A rocket motor casing formed from the maraging steel of claim 8.

* * * * *